United States Patent [19]

Langer

[11] Patent Number: 4,787,458

[45] Date of Patent: Nov. 29, 1988

[54] SPRING BOW, CENTRALIZER, AND RELATED METHODS

[75] Inventor: Friederich H. Langer, Houston, Tex.

[73] Assignee: Weatherford U. S., Inc., Houston, Tex.

[21] Appl. No.: 56,488

[22] Filed: May 29, 1987

[51] Int. Cl.[4] ..... E21B 17/10

[52] U.S. Cl. ..... 166/380; 166/241; 175/325

[58] Field of Search ..... 166/380, 241, 172; 175/325

[56] References Cited

U.S. PATENT DOCUMENTS

| | | | |
|---|---|---|---|
| 2,665,762 | 1/1954 | Althouse | 166/4 |
| 3,124,196 | 3/1964 | Solum | 166/241 |
| 3,312,285 | 4/1967 | Solum | 166/241 |
| 3,343,608 | 9/1967 | Solum | 166/241 |
| 3,566,965 | 3/1971 | Solum | 166/241 |
| 3,575,239 | 4/1971 | Solum | 166/241 |
| 4,088,186 | 5/1978 | Callihan | 166/241 |
| 4,520,869 | 6/1985 | Svenson | 166/241 |
| 4,531,582 | 7/1985 | Muse | 166/241 |
| 4,651,823 | 3/1987 | Spikes | 166/241 |

FOREIGN PATENT DOCUMENTS

| | | | |
|---|---|---|---|
| 1017112 | 10/1957 | Fed. Rep. of Germany | 166/241 |
| 259484 | 1/1968 | Fed. Rep. of Germany . | |
| P350808 | 3/1985 | Fed. Rep. of Germany . | |
| 605947 | 5/1978 | U.S.S.R. | 166/241 |
| 1110840 | 4/1968 | United Kingdom . | |

OTHER PUBLICATIONS 1986-87 Products and Services Catalog, Weatherford.
Product Information Cementing Aids GmbH, Weatherford, 1985.
API Specification for Casing Centralizers-American Petroleum Institute, 1986.
Control Formation Sand-Howard Smith Screen Company, 1982.
Primary Cementing Equipment for Better Well Completions-Gemoco, 1986.
Well Completion Service & Equipment Catelog B & W Incorporated 1974-1975 Catelog.

*Primary Examiner*—Jerome W. Massie
*Assistant Examiner*—Bruce M. Kisliuk
*Attorney, Agent, or Firm*—Vaden, Eickenroht, Thompson & Boulware

[57] ABSTRACT

A spring bow with a contact angle reduction member, a centralizer with such a bow, and methods for their use. The centralizer bow has a contact angle reduction member for affecting and reducing the angle of contact between the centralizer bow and the edge of an opening into which a centralizer with the bow is inserted. A spring bow with a tubular abutment member, a centralizer with such a bow and methods for their use. The centralizer bow has a tubular abutment member for affecting and increasing the bow restoring force. A spring bow with both a contact angle reduction member and a tubular abutment member, a centralizer with such a bow, and methods for their use.

15 Claims, 16 Drawing Sheets

Casing Centralizer Restoring Force Test Equipment.

Casing Centralizer Starting Force Test Equipment.

Casing Centralizer Test Positions.

FIG.16

TABLE: 2.1 SPECIFICATIONS: CASING CENTRALIZERS

| 1 | | 2 | | 3 | | 4 | |
|---|---|---|---|---|---|---|---|
| Casing Size | | Medium Wt. Casing | | Minimum Restoring Force at 0.67 Standoff Ratio | | Maximum Starting Force | |
| Inches | mm. | lb/ft. | kg/m. | Lbf | N | Lbf | N |
| 3.5 | 89 | 9.91* | 14.8 | 396 | 1761 | 396 | 1761 |
| 4.0 | 102 | 11.34 | 16.9 | 454 | 2019 | 454 | 2019 |
| 4.5 | 114 | 11.6 | 17.3 | 464 | 2064 | 464 | 2064 |
| 5.0 | 127 | 13.0 | 19.4 | 520 | 2013 | 520 | 2313 |
| 5.5 | 140 | 15.5 | 23.1 | 620 | 2758 | 620 | 2758 |
| 6.6 | 168 | 24.0 | 35.7 | 960 | 4270 | 960 | 4270 |
| 7.0 | 178 | 26.0 | 38.7 | 1040 | 4626 | 1040 | 4626 |
| 7.6 | *194 | 26.4 | 39.3 | 1056 | 4697 | 1056 | 4697 |
| 8.6 | 219 | 36.0 | 53.6 | 1440 | 6405 | 1440 | 6405 |
| 9.6 | 244 | 40.0 | 59.6 | 1600 | 7117 | 1600 | 7117 |
| 10.7 | 273 | 51.0 | 76.0 | 1020 | 4537 | 2040 | 9074 |
| 11.7 | 298 | 54.0 | 80.4 | 1080 | 4804 | 2160 | 9608 |
| 13.7 | 340 | 61.0 | 90.8 | 1220 | 5427 | 2440 | 10853 |
| 16.0 | 406 | 65.0 | 96.8 | 1300 | 5783 | 2600 | 11565 |
| 18.6 | 473 | 87.5 | 130.3 | 1750 | 7784 | 3500 | 15569 |
| 20.0 | 508 | 94.0 | 140.0 | 1880 | 8363 | 3760 | 16725 |

* Liner sizes and Plain-end weights

FIG. 21

TABLE I

| | | STC 06 | | STC 07 | | STC 09 | | CC 03 | | CC 04 | | CC 05 | |
|---|---|---|---|---|---|---|---|---|---|---|---|---|---|
| HARDNESS | | 43 | | 43 | | 43 | | 43 | | 43 | | 43 | |
| ST.F | Nx100 | 597 | 83.88% | 765 | 107.48% | 655 | 92.03% | 955 | 134.19% | 963 | 135.31% | 945 | 132.78% |
| N.F. | Nx100 | 371 | 52.13% | 313 | 43.98% | 401 | 56.34% | 396 | 55.64% | 405 | 56.91% | 412 | 57.89% |
| M.F.,% | of ST. | | 62.14% | | 40.92% | | 61.22% | | 41.47% | | 42.06% | | 43.60% |
| Nx100 | % of API | mm | % of ANN | mm | % of ANN | mm | % of ANN | mm | % of ANN | mm | % of ANN | mm | % of ANN |
| 0 | 0% | | | | | | | | | | | | |
| 50 | 7% | | | | | | | | | | | | |
| 100 | 14% | | | | | | | | | | | | |
| 150 | 21% | | | | | | | | | | | | |
| 200 | 28% | 29.83 | 89.46% | 28.90 | 86.69% | | | | | | | | |
| 250 | 35% | | | | | 28.74 | 86.21% | 29.75 | 89.24% | 30.55 | 91.64% | 30.61 | 91.87% |
| 300 | 42% | | | 28.83 | 86.48% | 28.55 | 85.64% | 29.64 | 88.91% | 30.43 | 91.28% | 30.44 | 91.31% |
| 350 | 49% | 29.65 | 88.94% | 28.60 | 85.79% | 28.32 | 84.95% | 29.51 | 88.52% | 30.29 | 90.86% | 30.25 | 90.74% |
| 400 | 56% | 29.27 | 87.80% | 28.29 | 84.86% | 28.00 | 83.99% | 29.35 | 88.04% | 30.15 | 90.44% | 30.05 | 90.14% |
| 450 | 63% | 28.87 | 86.60% | 27.92 | 83.75% | 27.49 | 82.46% | 29.19 | 87.56% | 30.02 | 90.05% | 29.84 | 89.51% |
| 500 | 70% | 28.40 | 85.19% | 27.45 | 82.34% | 27.02 | 81.05% | 29.03 | 87.08% | 29.82 | 89.45% | 29.56 | 88.67% |
| 550 | 77% | 27.93 | 83.78% | 26.98 | 80.93% | 26.56 | 79.67% | 28.84 | 86.51% | 29.62 | 88.85% | 29.25 | 87.74% |
| 600 | 84% | 27.44 | 82.31% | 26.51 | 79.52% | 26.02 | 78.05% | 28.60 | 85.79% | 29.37 | 88.10% | 28.83 | 86.48% |
| 650 | 91% | 26.90 | 80.69% | 26.01 | 78.02% | 25.51 | 76.52% | 28.34 | 85.01% | 29.09 | 87.26% | 28.37 | 85.10% |
| 700 | 98% | 26.32 | 78.95% | 25.46 | 76.37% | 24.98 | 74.93% | 28.03 | 84.08% | 28.77 | 86.30% | 27.90 | 83.69% |
| 750 | 105% | 25.71 | 77.12% | 24.87 | 74.60% | 24.49 | 73.46% | 27.72 | 83.15% | 28.43 | 85.28% | 27.45 | 82.34% |
| 800 | 112% | 25.08 | 75.23% | 24.26 | 72.77% | 23.95 | 71.84% | 27.40 | 82.19% | 28.05 | 84.14% | 27.03 | 81.08% |
| 850 | 119% | 24.50 | 73.49% | 23.73 | 71.18% | 23.33 | 69.88% | 27.02 | 81.05% | 27.67 | 83.00% | 26.60 | 79.79% |
| 900 | 126% | 23.97 | 71.90% | 23.19 | 69.56% | 22.72 | 68.15% | 26.60 | 79.79% | 27.28 | 81.83% | 26.12 | 78.35% |
| 950 | 133% | 23.44 | 70.31% | 22.64 | 67.91% | 22.14 | 66.41% | 26.18 | 78.53% | 26.90 | 80.69% | 25.67 | 77.00% |
| 1000 | 141% | 22.92 | 68.75% | 22.14 | 66.41% | 21.55 | 64.64% | 25.76 | 77.27% | 26.55 | 79.64% | 25.25 | 75.74% |
| 1050 | 148% | 22.45 | 67.34% | 21.66 | 64.97% | 21.04 | 63.11% | 25.35 | 76.04% | 26.18 | 78.53% | 24.85 | 74.58% |
| 1100 | 155% | 22.01 | 66.02% | 21.24 | 63.71% | 20.52 | 61.55% | 24.96 | 74.87% | 25.76 | 77.27% | 24.46 | 73.37% |
| 1150 | 162% | 21.57 | 64.70% | 20.93 | 62.78% | 20.43 | 61.28% | 24.58 | 73.73% | 25.36 | 76.07% | 24.06 | 72.17% |
| 1200 | 169% | 21.14 | 63.41% | 20.73 | 62.18% | | | 24.19 | 72.56% | 24.98 | 74.93% | 23.66 | 70.97% |
| 1250 | 176% | | | 20.37 | 61.10% | | | 23.80 | 71.39% | 24.61 | 73.82% | 23.29 | 69.86% |
| 1300 | 183% | | | 19.95 | 59.84% | | | 23.42 | 70.25% | 24.25 | 72.74% | 22.97 | 68.90% |
| 1350 | 190% | 20.30 | 60.89% | 19.53 | 58.58% | | | 23.05 | 69.14% | 23.92 | 71.75% | 22.67 | 68.00% |
| 1400 | 197% | | | | | | | 22.69 | 68.06% | 23.64 | 70.91% | 22.38 | 67.13% |
| 1450 | 204% | 21.14 | 60.41% | | | | | 22.33 | 66.98% | 23.37 | 70.10% | 22.08 | 66.23% |
| 1500 | 211% | | | | | | | 21.97 | 65.90% | 23.12 | 69.35% | 21.83 | 65.48% |
| 1550 | 218% | | | | | | | 21.63 | 64.88% | 22.87 | 68.60% | 21.60 | 64.79% |
| 1600 | 225% | | | | | | | 21.54 | 64.61% | 22.59 | 67.76% | 21.37 | 64.10% |
| R.F.@ 67% | ST.O. | | 146% | | 137% | | 130% | | 202% | | 232% | | 196% |
| ST.O.@ AP min R.F. | | | 76% | | 76% | | 74% | | 84% | | 86% | | 83% |

FIG. 22

TABLE II

| | | STC 19 | | STC 20 | | STC 21 | | CC 2 | | CC 3 | | CC 4 | | CC 5 | | CC 6 | | CC 7 | |
|---|---|---|---|---|---|---|---|---|---|---|---|---|---|---|---|---|---|---|---|
| HARDNESS | | 44 | | 44 | | 44 | | 44 | | 43 | | 43 | | 44 | | 43 | | 43 | |
| ST.F. | Nx100 | 488 | 68.57% | 503 | 70.68% | 575 | 80.79% | 681 | 95.69% | 662 | 93.02% | 755 | 106.08% | 710 | 99.76% | 687 | 96.53% | 678 | 95.26% |
| N.F. | Nx100 | 271 | 38.08% | 271 | 38.08% | 316 | 44.40% | 305 | 42.86% | 298 | 41.87% | 303 | 42.57% | 292 | 41.03% | 295 | 41.45% | 289 | 40.61% |
| M.F.,% of ST.F | | | 55.53 | | 53.88% | | 54.96% | | 44.79% | | 45.02% | | 40.13% | | 41.13% | | 42.94% | | 42.63% |
| Nx100 | % of API | mm | % of ANN | mm | % of ANN | mm | % of ANN | mm | % of ANN | mm | % of ANN | mm | % of ANN | mm | % of ANN | mm | % of ANN | mm | % of AN |
| 0 | 0% | | | | | | | | | | | | | | | | | | |
| 50 | 7% | | | | | | | | | | | | | | | | | | |
| 100 | 14% | | | | | | | | | | | | | | | | | | |
| 150 | 21% | | | | | | | | | | | | | | | | | | |
| 200 | 28% | 30.04 | 90.11% | 29.25 | 87.74% | 29.71 | 89.12% | | | | | 30.32 | 90.95% | 27.33 | 81.98% | 30.05 | 90.14% | 27.89 | 83.66% |
| 250 | 35% | 29.96 | 89.87% | 29.18 | 87.53% | 29.60 | 88.79% | 29.16 | 87.47% | 29.01 | 87.02% | 30.23 | 90.68% | 26.83 | 80.48% | 29.51 | 88.52% | 27.81 | 83.42% |
| 300 | 42% | 29.78 | 89.33% | 29.09 | 87.26% | 29.45 | 88.34% | 28.99 | 86.96% | 28.81 | 86.42% | 30.07 | 90.20% | 26.71 | 80.12% | 29.40 | 88.19% | 27.70 | 83.09% |
| 350 | 49% | 29.54 | 88.61% | 28.94 | 86.81% | 29.19 | 87.56% | 28.74 | 86.21% | 28.58 | 85.73% | 29.86 | 89.57% | 26.53 | 79.58% | 29.24 | 87.71% | 27.56 | 82.67% |
| 400 | 56% | 29.27 | 87.80% | 28.79 | 76.36% | 28.90 | 86.69% | 28.43 | 85.28% | 28.25 | 84.74% | 29.62 | 88.85% | 26.33 | 78.98% | 28.98 | 86.93% | 27.37 | 82.10% |
| 450 | 63% | 28.99 | 86.96% | 28.48 | 85.43% | 28.51 | 85.52% | 28.11 | 84.32% | 27.85 | 83.54% | 29.35 | 88.04% | 26.09 | 78.26% | 28.69 | 86.06% | 27.15 | 81.44% |
| 500 | 70% | 28.65 | 85.94% | 28.14 | 81.41% | 28.12 | 84.35% | 27.71 | 83.12% | 27.43 | 82.28% | 29.07 | 87.20% | 25.80 | 77.39% | 28.39 | 85.16% | 26.82 | 80.45% |
| 550 | 77% | 28.26 | 84.77% | 27.75 | 83.24% | 27.71 | 83.12% | 27.28 | 81.83% | 27.01 | 81.02% | 28.74 | 86.21% | 25.48 | 76.43% | 28.08 | 84.23% | 26.49 | 79.46% |
| 600 | 84% | | | 27.34 | 82.01% | 27.30 | 81.89% | 26.86 | 80.57% | 26.58 | 79.73% | 28.41 | 85.22% | 25.13 | 75.38% | 27.75 | 83.24% | 26.13 | 78.38% |
| 650 | 91% | 27.33 | 81.98% | 26.92 | 80.75% | 26.88 | 80.63% | 26.42 | 79.25% | 26.14 | 78.41% | 28.05 | 84.14% | 24.79 | 74.36% | 27.40 | 82.19% | 25.75 | 77.24% |
| 700 | 98% | 26.86 | 80.57% | 26.50 | 78.20% | 26.45 | 79.34% | 25.97 | 77.90% | 25.71 | 77.12% | 27.70 | 83.09% | 24.44 | 73.31% | 27.04 | 81.11% | 25.37 | 76.10% |
| 750 | 105% | 26.40 | 79.19% | 26.07 | 79.49% | 26.03 | 78.08% | 25.51 | 76.57% | 25.26 | 75.77% | 27.36 | 82.07% | 24.09 | 72.26% | 26.69 | 80.06% | 24.98 | 74.93% |
| 800 | 112% | 25.92 | 77.75% | 25.64 | 76.91% | 25.58 | 76.73% | 25.06 | 75.17% | 24.82 | 74.45% | 27.01 | 81.02% | 23.74 | 71.21% | 26.32 | 78.95% | 24.60 | 73.79% |
| 850 | 119% | 25.42 | 76.25% | 25.21 | 75.62% | 25.12 | 75.35% | 24.60 | 73.79% | 24.38 | 73.13% | 26.65 | 79.94% | 23.38 | 70.13% | 25.96 | 77.87% | 24.20 | 72.59% |
| 900 | 126% | 24.92 | 74.75% | 24.79 | 74.36% | 24.65 | 73.94% | 24.11 | 72.32% | 23.94 | 71.81% | 26.30 | 78.89% | 23.01 | 69.02% | 25.60 | 76.79% | 23.82 | 71.45% |
| 950 | 133% | 24.40 | 73.19% | 24.37 | 73.10% | 24.19 | 72.56% | 23.63 | 70.88% | 23.52 | 70.55% | 25.94 | 77.81% | 22.65 | 67.94% | 25.24 | 75.71% | 23.43 | 70.28% |
| 1000 | 141% | 23.87 | 71.60% | 23.95 | 71.84% | 23.73 | 71.18% | 23.14 | 69.41% | 23.10 | 69.29% | 25.58 | 76.73% | 22.30 | 66.89% | 24.89 | 74.66% | 23.06 | 69.17% |
| 1050 | 148% | 23.34 | 70.01% | 23.54 | 70.61% | 23.29 | 69.86% | 22.66 | 67.97% | 22.72 | 68.15% | 25.22 | 75.65% | 21.95 | 65.84% | 24.55 | 73.64% | 22.69 | 68.06% |
| 1100 | 155% | 22.82 | 68.45% | 23.13 | 69.38% | 22.85 | 68.54% | 22.18 | 66.53% | 22.40 | 67.19% | 24.87 | 74.60% | 21.59 | 64.76% | 24.21 | 72.62% | 22.32 | 66.95% |
| 1150 | 162% | 22.30 | 66.89% | 22.75 | 68.24% | 22.41 | 67.22% | 21.71 | 65.12% | 22.09 | 66.26% | 24.52 | 73.55% | 21.26 | 63.77% | 23.87 | 71.60% | 21.95 | 65.84% |
| 1200 | 169% | 21.80 | 65.39% | 22.36 | 67.07% | 22.00 | 65.99% | 21.23 | 63.68% | 21.77 | 65.30% | 24.18 | 72.53% | 20.94 | 62.81% | 23.54 | 70.61% | 21.59 | 64.76% |
| 1250 | 176% | 21.32 | 63.95% | 21.99 | 65.96% | 21.59 | 64.76% | 20.78 | 69.33% | 21.46 | 64.37% | 23.85 | 71.54% | 20.64 | 61.91% | 23.21 | 69.62% | 21.23 | 63.68% |
| 1300 | 183% | 20.81 | 62.42% | 21.67 | 65.00% | 21.20 | 63.59% | 20.38 | 61.18% | 21.15 | 63.44% | 23.54 | 70.61% | 20.35 | 61.04% | 22.91 | 68.72% | 20.89 | 62.66% |
| 1350 | 190% | 20.49 | 61.46% | 21.35 | 64.04% | 20.81 | 62.42% | 20.01 | 60.01% | 20.87 | 62.60% | 23.28 | 69.83% | 20.07 | 60.20% | 22.61 | 67.82% | 20.55 | 61.64% |
| 1400 | 197% | | | 21.04 | 63.11% | 20.46 | 61.37% | 19.65 | 58.94% | 20.58 | 61.73% | 23.00 | 68.99% | 19.80 | 59.39% | 22.32 | 66.95% | 20.23 | 60.68% |
| 1450 | 204% | 20.07 | 60.20% | 21.01 | 63.02% | 20.44 | 61.31% | 19.29 | 57.86% | 20.29 | 60.86% | 22.71 | 68.12% | 19.55 | 58.64% | 22.05 | 66.14% | 19.95 | 59.84% |
| 1500 | 211% | 19.66 | 58.97% | 20.68 | 62.03% | 20.09 | 60.26% | 18.97 | 56.90% | 20.05 | 60.14% | 22.45 | 67.34% | 19.32 | 57.95% | 21.77 | 65.30% | 19.75 | 59.24% |
| 1550 | 218% | 19.27 | 57.80% | 20.36 | 61.07% | | | 18.69 | 56.06% | 19.84 | 59.51% | 22.20 | 66.59% | 19.10 | 57.29% | 21.54 | 64.61% | 19.55 | 58.64% |
| 1600 | 225% | | | 20.03 | 60.08% | 20.06 | 60.17% | 18.55 | 55.64% | 19.65 | 58.94% | 21.99 | 65.96% | 18.92 | 56.75% | 21.30 | 63.89% | 19.34 | 58.01% |
| R.F.@ 67% ST.O. | | | 160% | | 169% | | 162% | | 151% | | 150% | | 207% | | 138% | | 185% | | 153% |
| ST.O.@ AP min R.F. | | | 80% | | 78% | | 79% | | 77% | | 76% | | 83% | | 73% | | 81% | | 75% |

SPRING BOW, CENTRALIZER, AND RELATED METHODS

BACKGROUND OF THE INVENTION

1. Field of the Invention

This invention relates to spring bows; to centralizing devices using such bows for maintaining a well conduit such as casing in a central position in a wellbore; and to methods for their use.

2. Description of the Prior Art

Centering devices known as "centralizers" have long been used in the oil industry for centering well pipe or casing in a wellbore, particularly in operations for cementing the casing in the wellbore. The most common conventional centralizers have two collars which are connected by and spaced apart by outwardly directed staves, springs or bows which engage and press against the wall of the wellbore.

Several disadvantages are associated with the use of centralizers with springs or bows with large bowed heights. The bowed portion of a spring can be pressed inwardly toward the casing on which the device is emplaced through the application of increasingly greater forces against it; so that with a large bowed height, a comparatively large compressive force is required to deflect the spring bow close to the casing to permit insertion into a wellbore. In starting a centralizer mounted on a casing string, the large height bowed portions are compressed inwardly to a great extent, since the opening into which the casing is inserted usually is not very much greater in diameter than the casing string itself. The bowed portions of the springs, therefore, are subjected to comparatively large forces in compressing them through the greater portion of their deflection toward the casing string, which requires a corresponding large force or load to be imposed downwardly upon the casing string. In many instances, with springs having large bowed heights, the centralizer cannot be started in the opening merely by the weight of the casing itself on which the centralizer is mounted. Often external weight or forces have to be applied on the casing string. The comparatively great force being exerted by the springs on the wall of the opening into which they are inserted creates correspondingly great forces between the springs and the surface casing, which must be overcome in lowering the casing string on which centralizer is mounted, and which may create wear on the springs.

The American Petroleum Institute's Specification 10D provides minimum performance standards, test procedures and marking requirements for casing centralizers. It defines various parameters relating to centralizers as follows:

a. Starting Force: Starting force is the maximum force required to start a centralizer into the previously run casing. The maximum starting force for any centralizer shall be less than the weight of 40 feet (12.2 m) of medium weight casing (see Table 2.1). The maximum starting force is to be determined for a centralizer in new, fully assembled, condition as delivered to the end user, i.e. before the bow springs are subjected to "permanent set." The maximum allowable starting force shall apply to the smallest hole size a centralizer is specified for.

b. Permanent Set: Permanent set is the attainment by the centralizer of a constant bow height less than the original bow height of the bow-springs after repeated flexing of the bow springs. A permanent set is considered established if the bow height remains constant after each spring has been flattened twelve times. The requirement to establish a permanent set of the bow springs before restoring force data are measured simulates the running of the centralizer through bore hole sections.

c. Running Force: Running force is the maximum force required to move a centralizer through the previously run casing. The running force is proportional to and always equal to or less than the starting force. It is a practical value which gives the maximum "running drag" produced by a centralizer in the smallest hole size specified.

Note: Starting and running force values are based on installation of the centralizer per manufacturer's recommendations. Both forces can increase substantially through "wrong" installation (i.e. a close tolerance centralizer which is, contrary to its design, installed over a casing collar).

d. Flattened: Flattened is defined as the point where the springs will not continue to deflect when three times the minimum restoring force is applied to the outer pipe during the starting force and running force tests.

e. Annular Clearance: Annular clearance is the distance between the outside of the casing and the borehole wall when the casing is perfectly centralized.

f. Standoff: For cases where the casing is not centralized, standoff is the smallest distance between the outside of the casing and the borehole wall.

g. Standoff Ratio: The standoff ratio is the ratio of standoff to annular clearance, expressed as a percentage.

For example:

For a 7 inch (178 mm) centralizer run in a 8½ inch (216 mm) hole, which is intended to maintain a standoff of 0.5 inches (12.7 mm) the standoff ratio is calculated as follows:

Annular clearance=

$$\frac{8.5-7}{2} = 0.750 \text{ inches}$$

$$\left(\frac{216-178}{2} = 19 \text{ mm}\right)$$

Standoff to annular clearance ratio $$= \frac{0.5}{0.750} = 0.67$$

$$\left(\frac{12.7}{19} = 0.67\right) \text{ or 67 percent}$$

h. Restoring Force: The restoring force is the force exerted by a centralizer against the casing to keep it away from the bore hole wall. The restoring force required from a centralizer, to maintain adequate standoff, is small in a vertical hole, but substantial for the same centralizer in a deviated hole.

Field observations indicate hole deviation on an average varies from zero to approximately 60 degrees: therefore, an average deviation of 30 degrees is used to calculate restoring force requirements, listed in Table 2.1.

For casing sizes $10\frac{3}{4}$ inches (273 mm) through 20 inches (508 mm), casing strings generally placed in relatively vertical hole sections, the minimum restoring force shall be not less than:

$$RF = W \text{ SIN } 30 = (W/2)$$

Where:

RF = Minimum restoring force

W = weight of 40 ft. (12.2 m) of medium weight casing

For casing sizes $4\frac{1}{2}$ inches (114 mm) through $9\frac{5}{8}$ inches (244 mm), casing strings generally placed in the deviated hole sections, the minimum restoring force shall be not less than:

$$RF = 2W \text{ SIN } 30 = W$$

The factor of 2 is established as a compensating factor for effect of doglegs.

Due to the applicability of many centralizers in a wise variety of hole sizes, any minimum restoring force specification for centralizer must be based on a standoff value or standoff ratio. A standoff ratio of 0.67 (67 percent standoff) is used in this standard for all minimum restoring force values.

Note: The previously stated ratio of 0.67 is not intended as a specification for adequate centralization of casing in the field, but merely for the purpose of specifying minimum performance standards. Actual restoring force values at various standoff's can be obtained from force-deflection curves as generated from the test procedure contained in Section 4 of this standard.

i. Hole Size Range: The hole size range for which a centralizer meets these specifications and is marked with, in compliance with Section 3, indicates the smallest and largest hole size for which such centralizer meets these specifications. The smallest hole size will be determined by the maximum starting force requirement, the largest by the minimum restoring force requirement.

In accordance with 37 C.F.R. §1.56, submitted herewith are copies of the following references which may be material to this application:

U.S. Pat. No. 2,665,762 discloses a centralizer having springs with comparatively large bowed heights which reduces force by providing a coupling collar for connection with the pin ends of casing, the coupling collar providing a stop member for contacting the upper or lower cage of the centralizer so that when a restriction or tight place is encountered the centralizers bows (springs) are urged inwardly to reduce the force.

U.S. Pat. No. 3,124,196 discloses a centralizer with inclined bows having an arcuate cross-section of sufficiently small radius to present a rounded surface engagement with the wellbore wall.

U.S. Pat. No. 3,566,965 discloses a centralizer with conventional bows and collars formed of a plurality of releasably connected segments which permit tiers of bows to be formed.

U.S. Pat. No. 3,575,239 discloses a centralizer wherein the position of some of its bows is longitudinally offset from other bows whereby less than all of the bows are engaged simultaneously when forcing the device into an opening.

U.S. Pat. No. 4,143,713 discloses a centralizer with its bows held by lugs to keep them engaged in their collars.

U.S. Pat. No. 4,520,869 discloses a centralizer having bows with a "hat" section for positioning in a channel in the collar. Compressing the channel into the bow hat section locks the bow in place.

U.S. Pat. No. 4,531,582 discloses a centralizer with bows having a concave configuration at their apexes, but not near their ends. An L-shaped extension of the collars serves as a restoring force increasing point after the bows have been depressed a certain amount.

German patent application No. P3508086.8-24 discloses a centralizer with axially offset asymmetrical bows. This German application is assigned to a sister company of the assignee of the present application.

U.K. Pat. No. 1,110,840 and Austrian Pat. No. 259,484 disclose a centralizer with collars and bows with a number of U-shaped, outwardly-directed extensions which are received into and secured in the collars. These two patents are assigned to a sister company of the assignee to the present application.

API Spec 10D discloses various general information about centralizers.

B&W Incorporated's 1974–1975 catalog (excerpt) discloses centralizer bows with an arched shape.

"Control Formation Sand," Howard Smith Screen Company, 1982, discloses a variety of conventional centralizers. (See p. 19).

"Primary Cementing Equipment," GEMOCO, 1986 discloses a variety of centralizers and bows.

Weatherford, "Product Information Cementing Aids GmbH," 1985 discloses a variety of prior art bows and centralizers. Weatherford Oil Tool GmbH is a sister company to the assignee of the present application.

Weatherford, "1986–87 Products and Services Catalogs," 1985 (primarily pages 22–28) discloses a variety of prior art bows and centralizers. Weatherford International, Inc. is the parent company of the assignee of the present application.

Generally, the centering force requirement dictates the use of heavy material in the bows, a large number of bows, and a profile with the bows directed outwardly a substantial distant—and yet the centralizer must be inserted into a tubular or bore that is relatively small in circumference. A substantial resistance to insertion is encountered due to, inter alia, the force between the bows and the tubular or bore into which the centralizer is to be inserted.

There has long been a need for a centralizer with a low starting force, yet with a high restoring force.

SUMMARY OF THE PRESENT INVENTION

The present invention is directed to a new centralizer. In one embodiment the new centralizer has a reduced starting force. In another embodiment it has an increased restoring force. Aspects of each can be combined in one centralizer having an increased restoring force and a reduced starting force.

Starting force is dependent, inter alia, on the angle, "contact angle", of the centralizer bows with respect to the inner edge of the bore or tubular into which the centralizer is to be inserted. A centralizer according to the present invention has collars between which extend spring bows. The bows protrude outwardly from the longitudinal axes of the collars. One or more of the bows is configured so that the contact angle is reduced for a portion of the bow. This configuration is effected by providing a contact angle reduction member on a portion of the bow which will contact the inner edge of the bore or tubular into which the centralizer is to be inserted. The contact angle reduction member can be formed and positioned so that its presence does not significantly affect the centralizer's restoring force or has such an effect on it that the advantages with respect to reduced starting force are still desirable.

A bow according to the present invention has one or more contact angle reduction members. A centralizer may only need contact angle reduction members at one end of its bows, but a centralizer could be fool-proofed by providing such members at both ends so that whichever end is inserted will have a reduced starting force. The contact angle reduction members can be formed integrally of the bows or they can be separate pieces secured to the bows.

Restoring force is the force exerted by a centralizer bow when the centralizer contacts a restricted inside diameter of a tubular, testpipe, or wellbore. Restoring force is dependent, inter alia, on the extent to which the bow has to be compressed upon insertion into the wellbore. A bow which is stressed beyond its elastic limit may not have an adequate restoring force.

A bow according to the present invention has one or more casing (or tubular) abutment members on at least one end of the bow for contacting the casing (or other tubular) after the bow has moved inwardly on the casing upon insertion into the wellbore. The casing abutment member prevents, to some extent, movement of the bow (or of part of the bow), toward the casing thereby preventing further reduction in restoring force. A bow may need casing abutment numbers at only one of its ends, but a centralizer bow according to this invention may have such members at each of its ends. The casing abutment members can be formed integrally of the bows or they can be separate pieces secured to the bows. A single bow can have both one or more contact angle reduction members and one or more casing abutment members.

It is, therefore, an object of the present invention to provide a new spring bow.

It is another object of the present invention to provide a centralizer bow with a reduced starting force.

Yet another object of the present invention is the provision of a centralizer bow with an increased restoring force.

A further object of the present invention is the provision of centralizer bow with a reduced starting force and an increased restoring force.

It is another object of this invention to provide centralizers with such bows.

Another object of the present invention is the provision of a centralizer with one or more bows having a contact angle reduction member.

Yet another object of the present invention is the provision of a bow having a contact angle reduction member.

An additional object of the present invention is the provision of a centralizer bow having a contact angle reduction member which is stamped out from or pressed out from the bow itself.

A further object of the present invention is the provision of a centralizer with one or more such bows.

Another object of the present invention is the provision of a centralizer bow having secured thereto a contact angle reduction member.

Yet another object of the present invention is the provision of a centralizer with one or more such bows.

An additional object of the present invention is the provision of a centralizer bow which has a contact angle reduction member found integrally thereof.

A further object is the provision of a centralizer with one or more such bows.

A particular object of the present invention is the provision of a centralizer bow having a contact angle reduction member at each of its ends. Another particular object of the present invention is the provision of a centralizer with one or more such bows.

Another particular object of the present invention is the provision of centralizers with reduced starting force which meet or exceed the American Petroleum Institute's specifications for casing centralizers.

A further object of the present invention is the provision of a centralizer which satisfies the long-felt need for a centralizer with reduced starting force and acceptable restoring force.

Another object of the present invention is the provision of a centralizer with one or more bows having a tubular abutment member.

Yet another object of the present invention is the provision of a spring bow having a tubular abutment member.

An additional object of the present invention is the provision of a spring bow having a tubular abutment reduction member which is stamped out from or pressed out from the bow itself.

A further object of the present invention is the provision of a centralizer with one or more such bows.

Another object of the present invention is the provision of a spring bow having secured thereto a tubular abutment member.

Yet another object of the present invention is the provision of a centralizer with one or more such bows.

An additional object of the present invention is the provision of a centralizer bow which has a tubular abutment member found integrally thereof.

A further object is the provision of a centralizer with one or more such bows.

A particular object of the present invention is the provision of a bow having a tubular abutment member at each of its ends. Another particular object of the present invention is the provision of a centralizer with one or more such bows.

Another particular object of the present invention is the provision of centralizers with increased restoring forces which meet or exceed the American Petroleum Institute's specifications for casing centralizers.

A further object of the present invention is the provision of a centralizer which satisfies the long-felt need for a centralizer with reduced starting force and increased restoring force.

To one of skill in this art who has the benefit of this invention's teachings other and further objects and advantages will be clear from the following description of presently-preferred embodiments of the invention, where considered with the drawings submitted herewith.

BRIEF DESCRIPTION OF THE DRAWINGS

FIG. 16 is the API's Table 2.1 of specifications for casing centralizers.

FIG. 21 presents test data for prior art devices.

FIG. 22 presents test data for apparatus according to the present invention.

FIG. 24 to FIG. 22 "STC" data; FIG. 25 to FIG. 21 "CC" data; and FIG. 26 to FIG. 22 "CC" data.

DESCRIPTION OF PRESENTLY PREFERRED EMBODIMENTS

Figure 1:
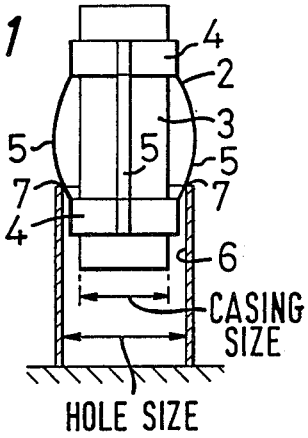
FIG. 1 is a cross-sectional view of a prior art centralizer disposed on casing and partially emplaced within a borehole.

As shown in FIG. 1 a conventional prior art centralizer 2 disposed about a casing 3 has two end collars 4 spaced about by a plurality of spring bows 5 connected to the collars 4. The centralizer 2 and casing 3 have been partially inserted into the wellbore 6. Bows 5 of the centralizer 2 have contacted the upper edge 7 of the test pipe or wellbore 6.

Figure 2:
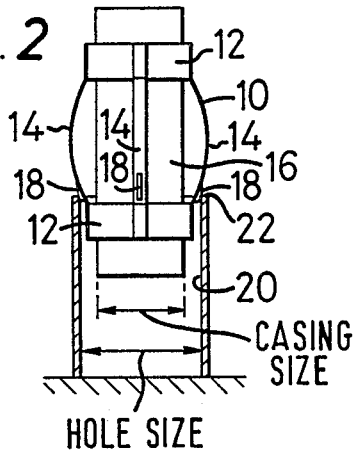
FIG. 2 is a cross-sectional view of a centralizer according to the present invention disposed on casing and partially emplaced in a borehole.
Figure 3:
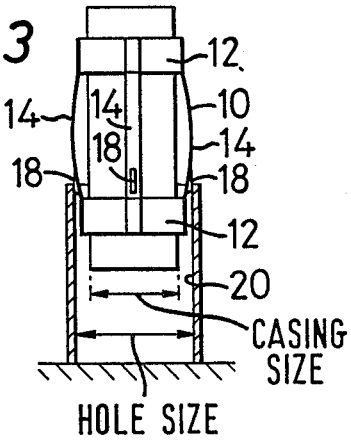
FIG. 3 is a view of the centralizer of FIG. 2 after it has proceeded to enter further into the borehole (a distance equal to the distance which the centralizer of FIG. 1 has proceeded into the borehole).

A centralizer 10 according to the present invention is shown in FIGS. 2 and 3. The centralizer 10 has two end collars 12 to which and between which are secured a plurality of bows 14. The centralizer 10 is disposed about a casing 16. The bows 14 have secured thereto a contact angle reduction member 18.

The casing 16 and centralizer 10 have been partially inserted into a borehole 20. The illustration of FIG. 3 shows the further progression of the casing 16 and centralizer 10 into the borehole 20 and the further movement of the contact angle reduction member on the upper edge 22 of the borehole 20.

Figure 1A:
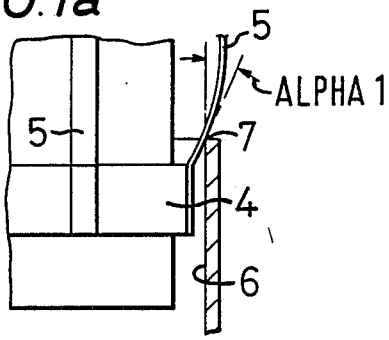
FIG. 1*a* is an enlargement of a portion of FIG. 1 showing the angle Alpha 1 between the centralizer bow and the hole wall.
Figure 2A:
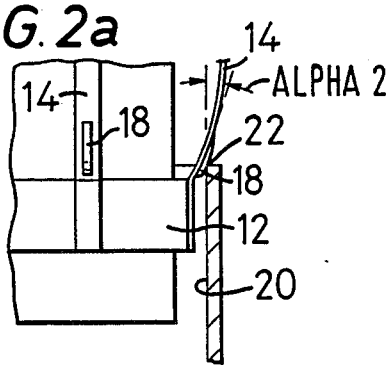
FIG. 2*a* is an enlargement of a portion of FIG. 2 showing the angle Alpha 2 between the centralizer bow and the hole wall.
Figure 3A:
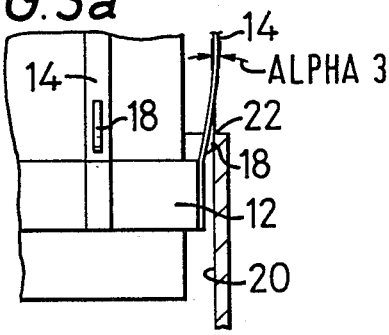
FIG. 3*a* is an enlargement of a portion of FIG. 3 showing the angle Alpha 3 between the centralizer bow and the hole wall.

The difference on contact angle for the prior art centralizer 2 and the centralizer 10 according to the present invention is shown in FIGS. 1*a*, 2*a* and 3*a* which correspond to the apparatus of FIGS. 1, 2, and 3, respectively. The contact Alpha 1 angle of bow 5 of centralizer 2 with respect to the edge 7 (FIG. 1*a*) is greater than the contact angle Alpha 2 of the bow 14 of the centralizer 10 with respect to the edge 22 (FIG. 3*a*). A portion of the bow 14 (FIG. 2*a*) corresponding to the surface of the contact angle reduction member in contact with the borehole wall has a smaller contact angle than it would if the member 18 were absent. The contact angle Alpha 3 shown in FIG. 3*a* is relatively small. The contact angle Alpha 3 is for a centralizer 10 which has been inserted the same distance into the hole as the centralizer 2 of FIG. 1. The contact angle reduction member 18 (FIGS. 2, 3) contacts the upper edge of the hole sooner than the bows 5 of the device of FIG. 1.

FIGS. 4–8 illustrate various embodiments of centralizer bows according to the present invention. A bow 40 shown in FIG. 4 has a contact angle reduction member 42 produced by attaching a separate piece to the bow 40. Conventional epoxy resin glues serve to secure the member 42 to the bow 40. A bow 50 shown in FIG. 5 has a contact angle reduction member 52 produced by stamping the bow with a cutting/forming die or with a separate cutting die and separate forming die. This could be done during the bow shaping process. The member 52 is stamped so that it is connected to the bow body only along line 54 and the end 56 has been turned inwardly to insure that the bow 50 is insertable into an opening and does not act as a stop member against the upper edge of a hole. The member 52 could be disconnected along line 54 and connected at its other end to the bow.

Figure 6:
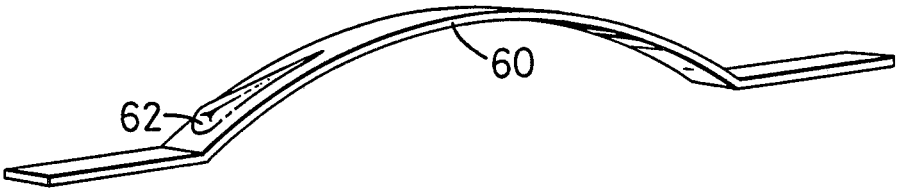
Figure 7:
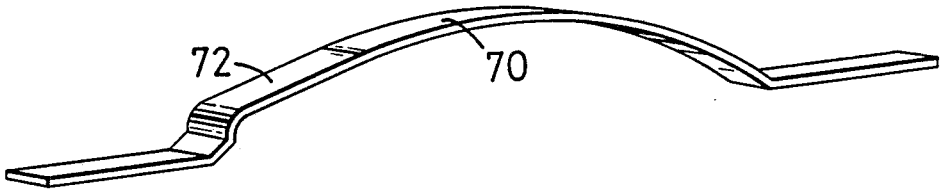

A bow 60 shown in FIG. 6 has a contact angle reduction member which was originally part of the bow, but which has been pressed out of the bow 60. The contact reduction members themselves can be formed of any suitable rigid material, including but not limited to: metals, plastics, elastomers, or composite materials. A bow 70 as shown in FIG. 7 is a single integral piece which is made, formed, cast, or stamped to have a contact angle reduction member 72 formed integrally thereof.

Figure 8:
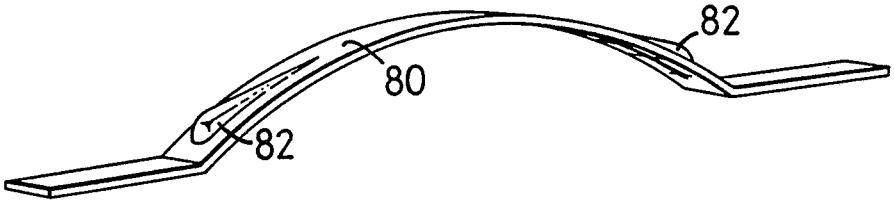

A bow 80 shown in FIG. 8 has conduct angle reduction member 82 at each of its ends so that whichever end encounters the upper edge of a hole, the contact angle is reduced.

Figure 9:
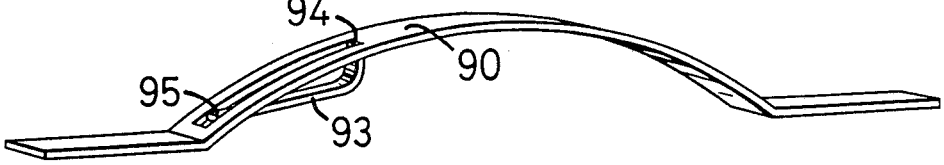
FIGS. 9 and 10 are perspective views of bows according to the present invention which have tubular abutment members according to the present invention.
Figure 10:
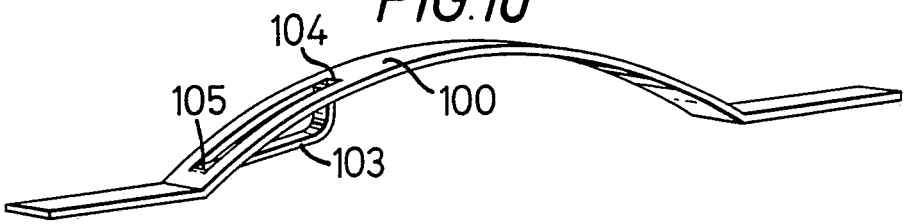

The bows 90 and 100 of FIGS. 9 and 10 respectively, each have a tubular abutment member for contacting the tubular or casing on which a centralizer with the bow has been placed. Tubular abutment member 93 is formed by the process used to produce contact angle reduction member 52 of bow 50. The member 93 is connected to bow 90 along line 94 and disconnected at its other end 95. Initially upon compression of the bow 90 in the hole, the member 93 will move with the bow 90 and not affect the bow movement. Eventually the member 93 will contact the surface of the tubular and will prevent to some extent further radially inward movement of the bow 90. This increases restoring force because of reduction of free bow length as well as active bow height. The bow 100 (FIG. 10) has the tubular abutment member 103 which is disconnected along line 104 and is connected along line 105 to the bow body.

Figure 11:
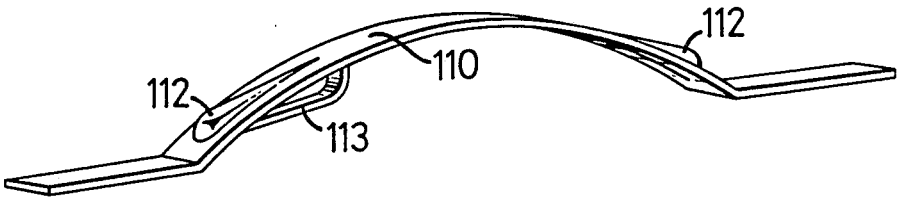
FIGS. 11 and 12 are perspective views of bows according to the present invention with both a contact angle reduction member and a tubular abutment member.
Figure 12:
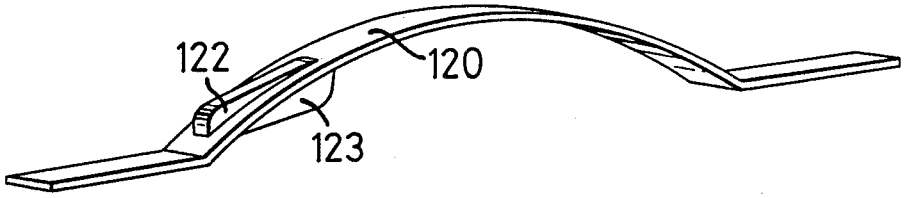

FIGS. 11 and 12 illustrate bows with both contact angle reduction members and tubular abutment members. A bow 10 shown in FIG. 11 has two contact angle reduction members 112 (similar to member 62 of bow 60) and a tubular abutment member 113 (similar to member 93 of bow 90). A bow 120 shown in FIG. 12 has a contact angle reduction member 122 (similar to member 42 of bow 40) and a tubular abutment member 123 which is a solid separate piece glued to the bow 120.

Figure 4:
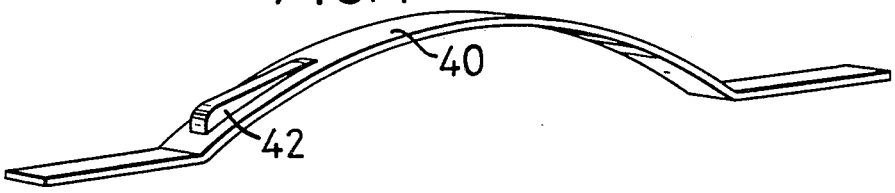
FIGS. 4–8 are perspective views of centralizer bows according to the present invention.
Figure 5:
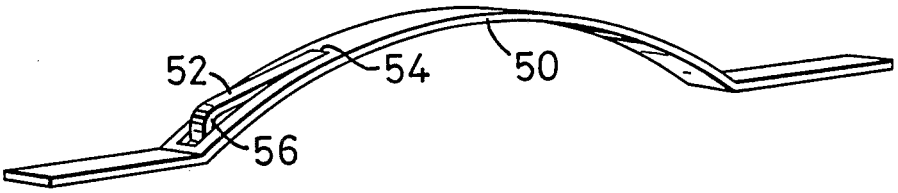
Figure 13:
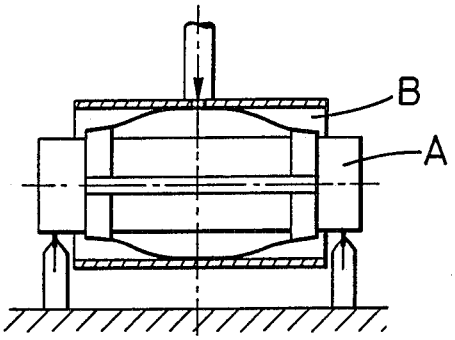
FIG. 13 is a cross-sectional view of a testing jig according to FIG. 4.1 of the API test for casing centralizers.
Figure 14:
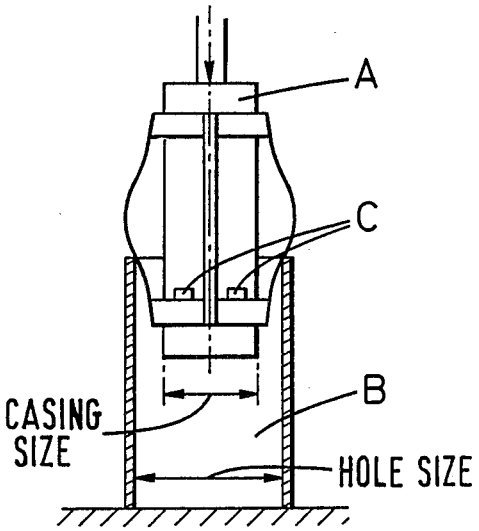
FIG. 14 is a cross-sectional view of a centralizer and hole as shown in FIG. 4.2 of the API test procedure.
Figure 15:
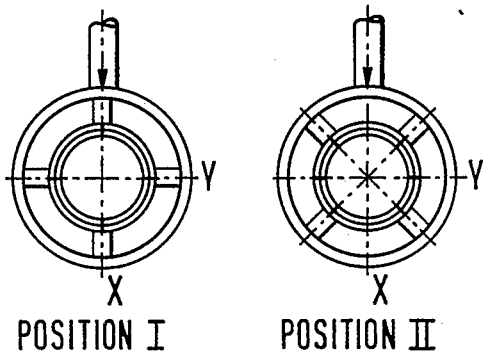
FIG. 15 is a top view of casing centralizer test positions as shown in FIG. 4.3 of the API test procedure.

The American Petroleum Institute's (API) has recommended testing procedure for casing centralizers is as follows:

The following suggested testing equipment is optional. Variations are possible without affecting test validity or the ultimate results. For example: a testing jig may be designed to apply force from below instead of at the top as shown in FIG. 13 (FIG. 4.1). Also, the starting force assembly may be set up to pull the centralizer from the bottom instead of as shown in FIG. 14 (FIG. 4.2). Variations such as these are being used by some manufacturers and are entirely acceptable. Testing jig should be similar to that shown in FIG. 13 (FIG. 4.1). In all tests, outside diameter of the inner casing A and the inside diameter of the outer pipe B should correspond to common casing-hole size combinations. When a hole size is not available as a standard pipe inside diameter, a machined inside diameter with a 250 RMS finish will be acceptable. The outer surface of casing A and the inner surface of pipe B should resemble in smoothness API casing delivered from the pipe mill. The contacting surfaces should not show any mechanical damage and should be lubricated with a petroleum base grease before running the test. NOTE: API Modified type grease is recommended as a standard grease for the test. Other greases are allowable. Both pipes A and B should be completely cylindrical and their axial measurements longer than the total length of the centralizer under investigation after it is completely flattened. The centralizer to be tested should be attached to the casing in a manner similar to the method recommended by the centralizer manufacturer. Load measurements may be taken on a suitable tension-compression test machine that can be read accurately to one percent.

Figure 17:
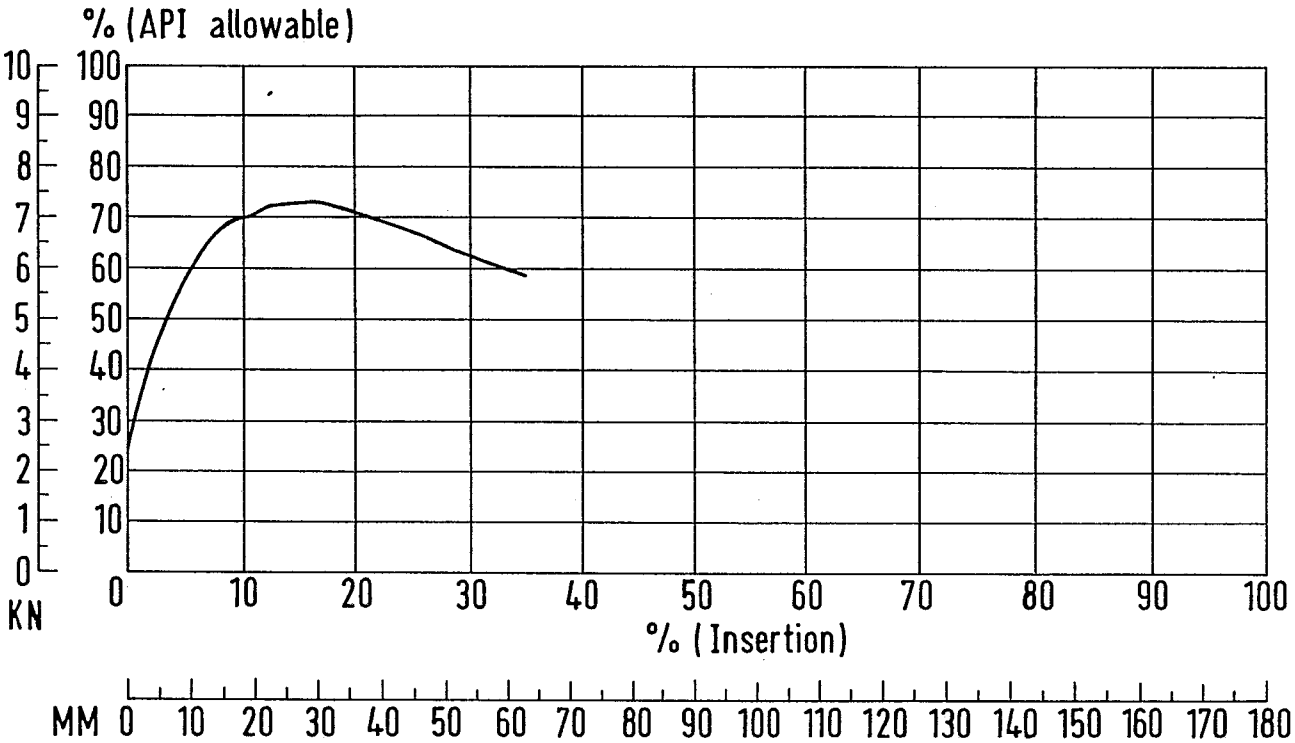
FIG. 17 presents data for a prior art device.
Figure 17A:
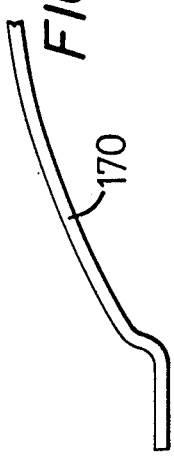
FIG. 17*a* shows a centralizer bow, side view, corresponding to a bow tested for the data presented in FIG. 17.

FIG. 17 presents data regarding starting force for a prior art bow such as a bow 170 as shown in FIG. 17*a*. The horizontal axis labelled "MM" shows increasing movement in millimeters of a centralizer with a bow 170 into a test pipe. The vertical axis has two labels. The "%" column indicates percentage of API allowable maximum starting force. The vertical column labelled "KN" indicates starting force in kilonewtons. The test method used was a conventional "over stop collar" method and the centralizer tested with bows 170 was a prior art Weatherford ST-III-S centralizer (as described in "Product Information Cementing Aids GmbH" a copy of which is submitted herewith).

As shown in FIG. 17, the starting force for the prior art centralizer had a maximum of about 72% of the API allowable after about 27 millimeters of insertion into the test pipe.

Figures 18, 18A:
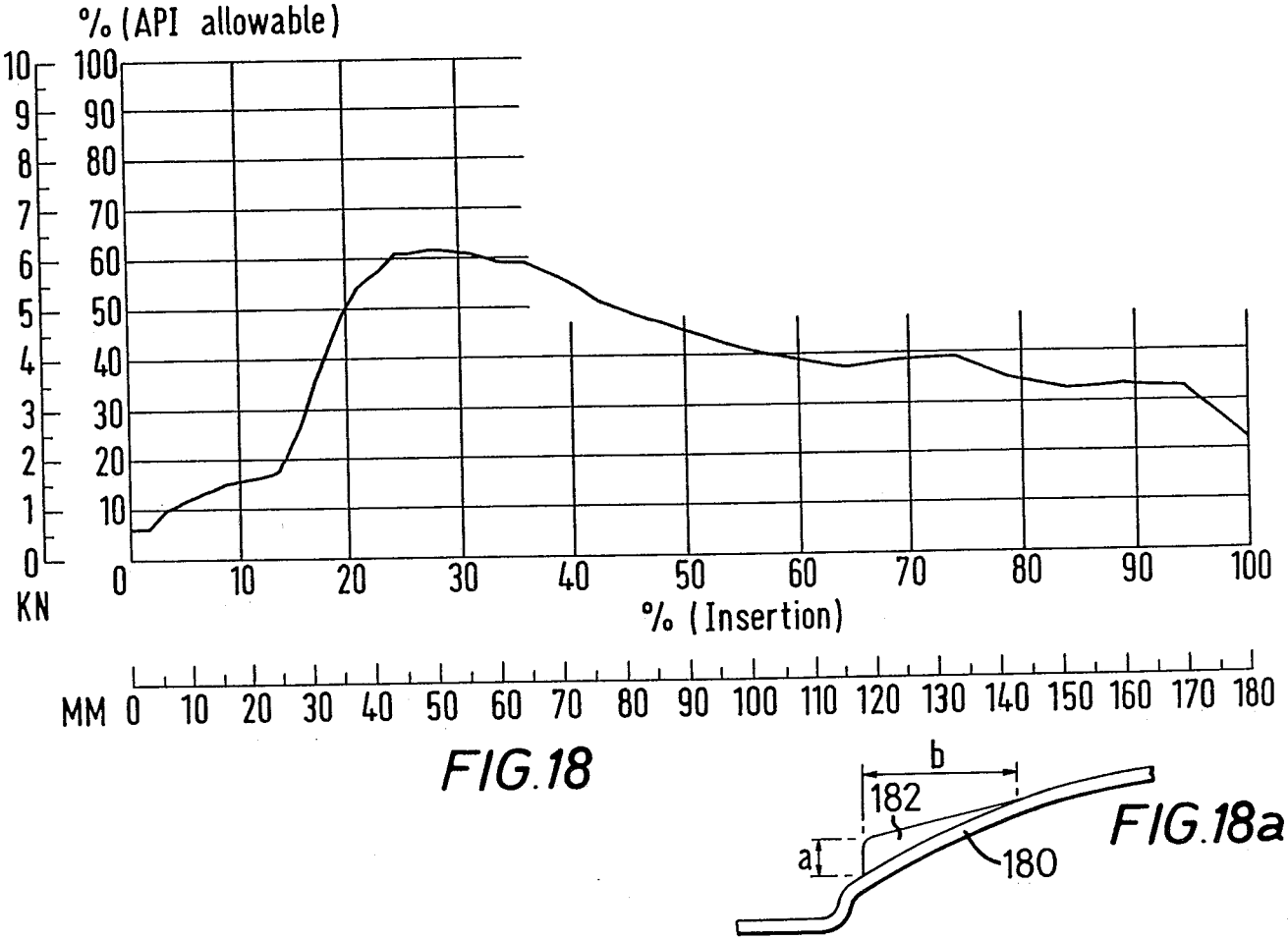
FIGS. 18–20 present data for apparatus according to the present invention having a contact angle reduction member.
FIGS. 18*a*, 19*a*, and 20*a* show a centralizer bow, side view, corresponding to a bow tested for the data obtained which is presented in FIGS. 18, 19 and 20, respectively.
Figure 19:
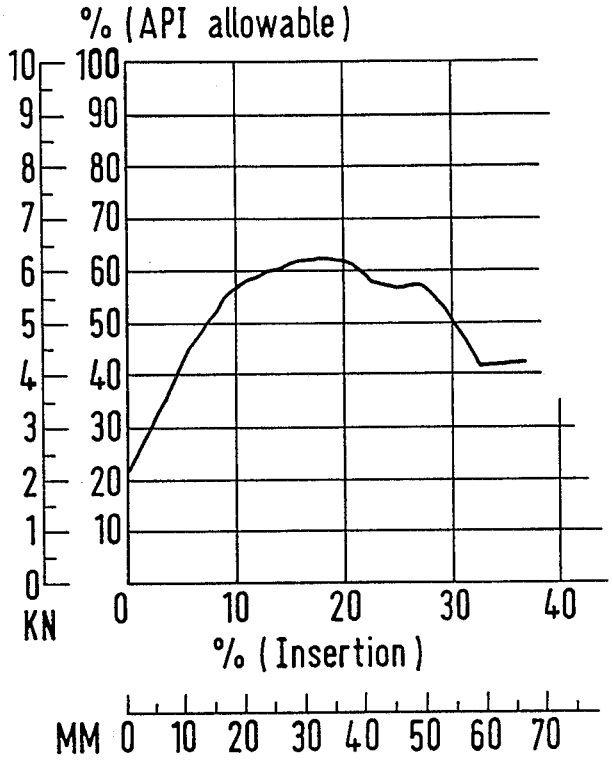
Figure 19A:
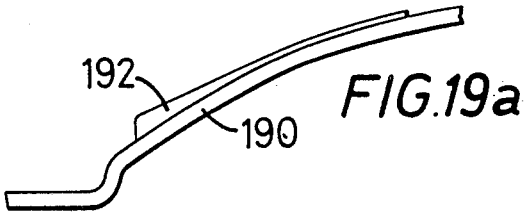
Figure 20:
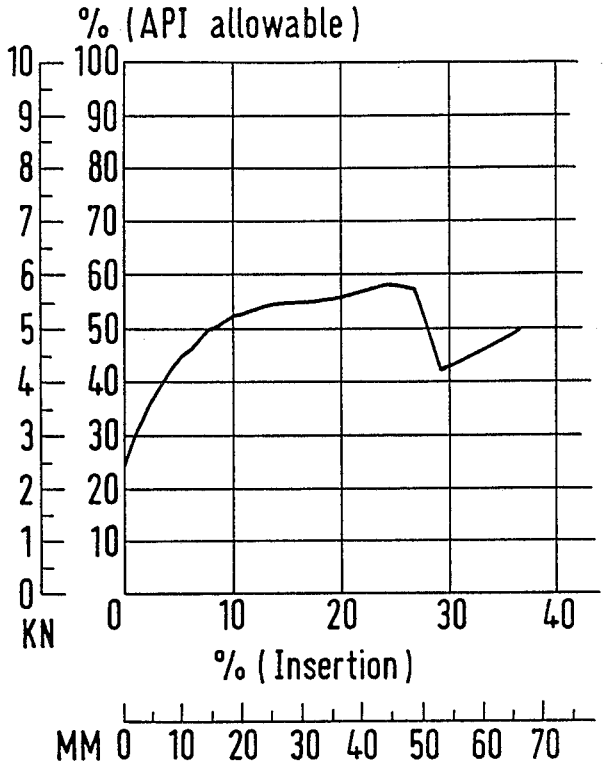

Centralizers according to the present invention were tested with bows 180, 190, 200 according to the present invention. (See FIGS. 18*a*, 19*a*, 20A, respectively). Each bow 180, 190, 200 had a separate contact angle reduction member 182, 192, 202 respectively secured there to with commercially available epoxy glue. As shown in the graphics of FIGS. 18, 19, and 20 the different geometry of the members 182, 192, 202 produced different results, but the maximum starting force for each centralizer was reduced as compared to the centralizer tested with bows 170.

Figure 20A:
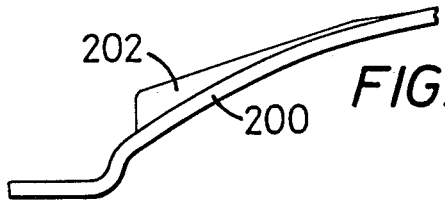

For the prior art device of FIG. 17*a* the starting force was about 7.3 KN or about 1640 lbs. The corresponding data for the devices of FIGS. 18*a*, 19*a*, and 20*a* is as follows:

18*a* 6.220 KN
19*a* 6.224 KN
20*a* 5.872 KN

After tests were run on the bows of FIGS. 18*a* –20*a*, existing dies were changed to produce contact angle reduction members with more rounded ends for contacting the edge of a hole (or testpipe) by pressing a rounded ridge with its height decreasing toward the apex of the bow.

Height measurement "a" for contact angle reduction member 182 was about 12 mm and length measurement "b" was about 49 mm. Member 192's height was about 6 mm and length was about 80 mm. Member 202's height was about 12 mm and length was about 80 mm.

The chart shown in FIG. 21 presents test data for the prior art centralizer (ST-III-S) having six bows. In the charts (FIGS. 21 and 22), terms have the following meanings:

STC: "over stop collar" test data.
CC: "casing collar" test data.
HARDNESS: Rockwell Hardness.
ST.F. N×100: Starting Force in Newtons multiplied by 100.
M.F. N×100: Moving Force in Newtons multiplied by 100 (=Running Force per API definition).
M.F., % of ST.F.: Moving Force as a percentage of starting force.
% of API: Clearance.
N×100: Newtons muliplied by 100.
R.F. @ 67% of ST.O. Restoring Force at 67% Standoff (=67% Annulus)
ST.O. @ API
min. R.F.: Standoff at API specified minimum Restoring Force.
% of ANN: Percent of annulus or standoff.
MM: Millimeters of standoff.

The chart shown in FIG. 22 presents test data for a centralizer according to the present invention which was made by securing contact angle reduction members to the bows of the centralizer of FIG. 21.

FIGS. 23–26 give a graphical illustration of the tabulated form of FIGS. 20 and 21. They show the respective starting and moving forces as horizontal lines, scaled as percentages of API maximum allowable starting force and/or minimum required restoring force. A vertical line (dash-dot) represents the 100% API load for both starting and restoring force. Restoring force is shown as a group of curves with the Y-axis being scaled in percentages of the theoretical ideal annular space (12.25–9.625)/2. the so-called API restoring point is marked at 100% and 67% of this ideal annulus.

Figure 23:
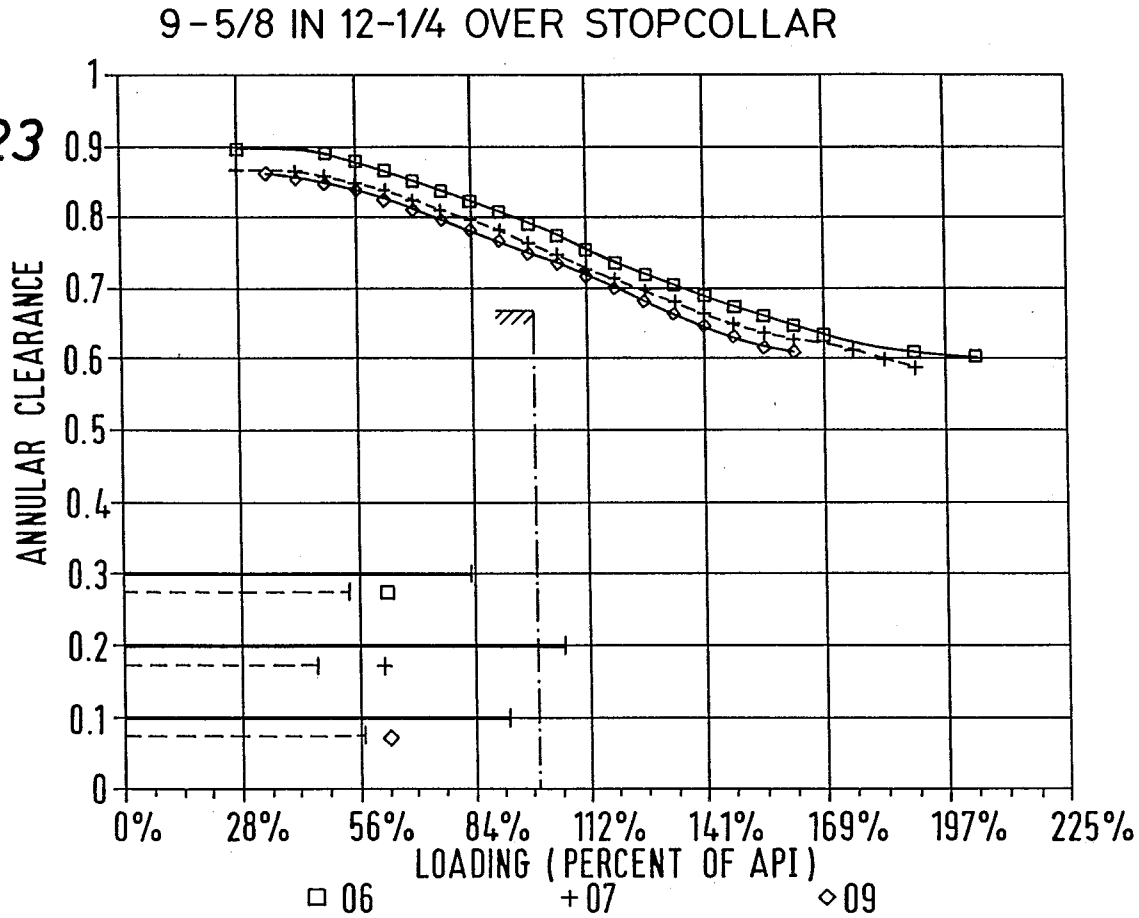
FIGS. 23–26 present graphically the data of FIGS. 21, 22, FIGS. 23 corresponding to FIG. 21 "STC" data.

FIG. 23 shows graphically the data for the prior art centralizer's "over stop collar" test from FIG. 21

Figure 25:
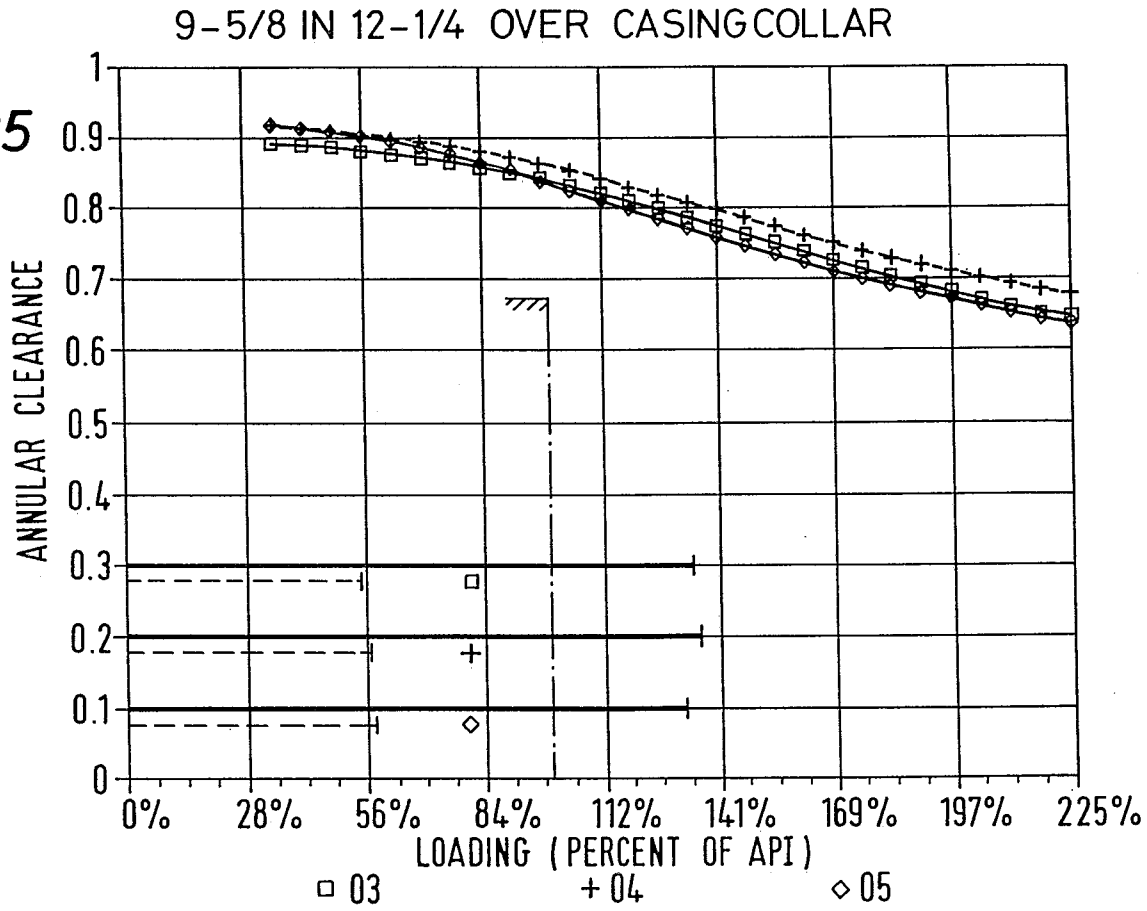

("STC" data). FIG. 25 shows graphically the data for the prior art centralizer's "over casing collar" tests from FIG. 21 ("CC" data). The square symbol in FIG. 23 indicates the graph lines (dashed and dark) corresponding to the data for tests 06 of FIG. 21. The plus symbol corresponds to tests 07 of FIG. 21 and the diamond symbol corresponds to tests 09 of FIG. 21. Similarly for FIG. 25 the square symbol corresponds to tests 03; the plus symbol to tests 04; and the diamond symbol to tests 05—all of FIG. 21.

In general terms these graphs show the annular clearance which the centralizer provides under different loads (restoring force). The horizontal dark full lines in the lower left corner of the graphs (FIGS. 23–26) show starting force and the dashed lines show moving force of the respective centralizers.

Figure 24:
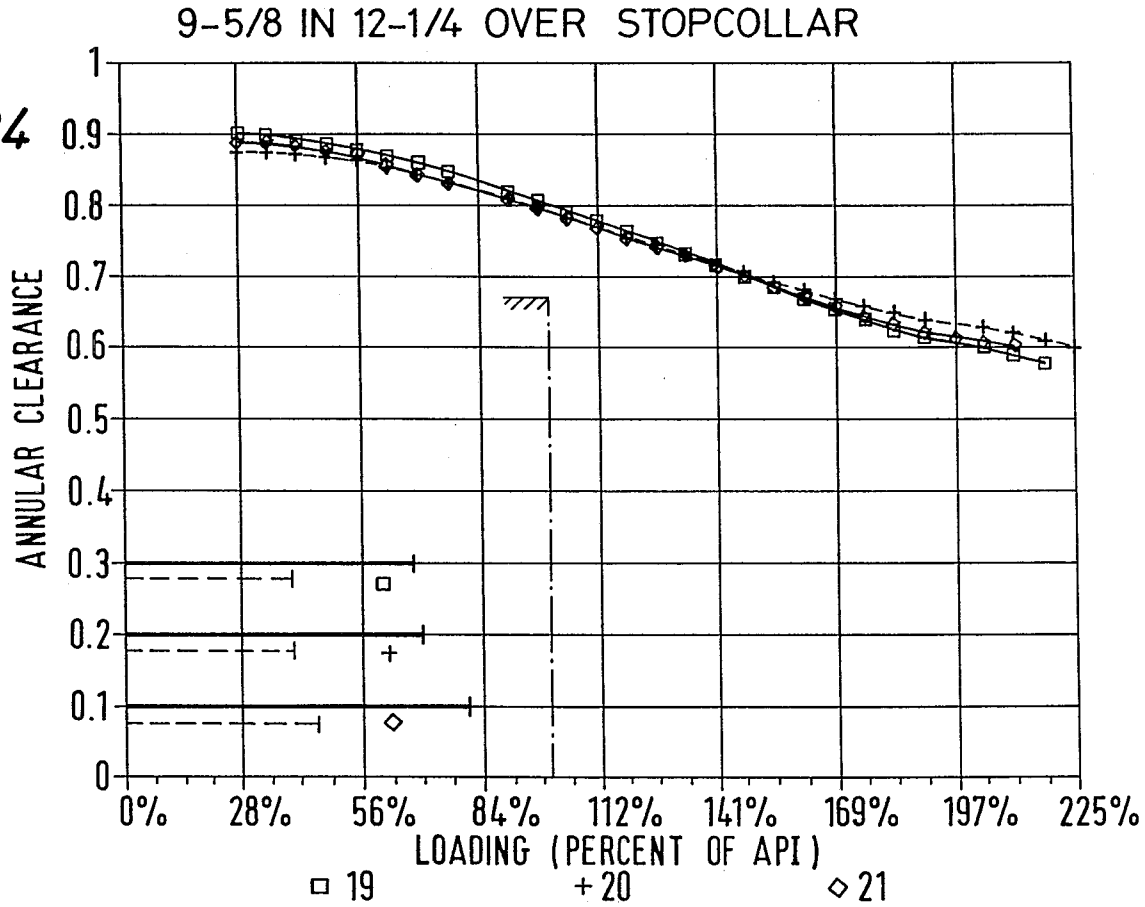
Figure 26:
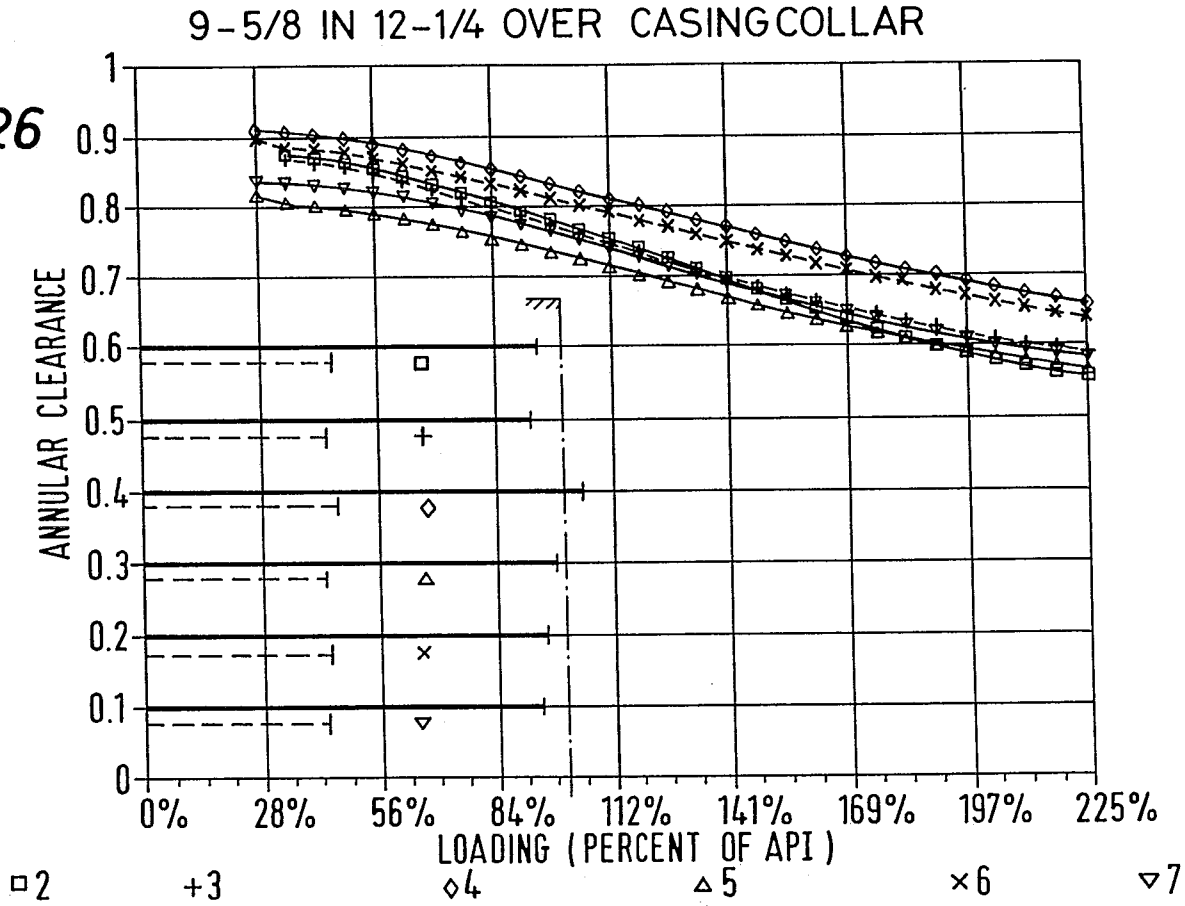

Similarly, FIGS. 24 and 26 present data for centralizers according to the present invention. FIG. 24 presents the "over stop collar" data and FIG. 26 presents the "over casing collar" data. In FIGS. 24 and 26 the symbols on the graphs correspond to the tests 19, 20, 21, 2, 3, 4, 5, 6 and 7 of FIG. 22 as indicated.

Tests were performed with centralizers installed over stopcollars and over casing collars because both installations are common in drilling operations. As can be seen in FIG. 21, the centralizer with bows without contact angle reduction members showed starting forces (ST.F.) of between 5.97 KN and 7.65 KN or between 83.88% and 107.9% of API allowable, respectively, for installation over stopcollar. FIG. 22 shows the starting force for the same type bows, but with contact angle reduction members according to the present invention, between 4.88 KN and 5.75 KN or between 68.57% and 80.79% of API allowable for this type installation. The resulting reduction is therefore between 18% and 25% for installation over stopcollar. For installation over casingcollar, FIG. 21 shows starting forces for the prior art devices to be between 9.45 KN and 9.63 KN or 132.78% and 135.31% of API allowable, while bows with contact angle reduction members as taught by the present invention of FIG. 22 show it to be between 6.62 KN and 7.55 KN or between 93.02% and 106.08% of API allowable. In this case the reduction achieved by use of bows according to this invention is between 30% and 22%. Discounting the case of 7.55 KN which is considered to be a testing anomaly, the reduction achieved is between 30% and 26%.

Figure 27:
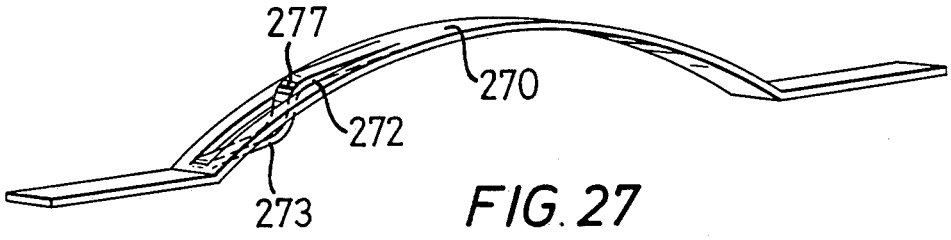
FIGS. 27 and 28 are perspective views of bows according to the present invention having a compound contact angle reduction member and tubular abutment member.
Figure 28:
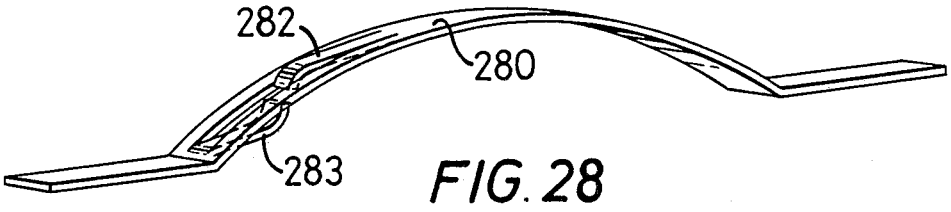

FIGS. 27 and 28 illustrate bows according to the present invention which have both a contact angle reduction member and a tubular abutment member. A bow 270 shown in FIG. 27 has a compound member 277 which includes both a contact angle reduction member 272 and a tubular abutment member 273 formed integrally thereof. A bow 280 shown in FIG. 28 has a contact angle reduction member 282 connected at one end to the body of the bow 280. The bow 280 has a tubular abutment member 283 connected at one end to the body of the bow 280. Of course either of the members 282 and 283 could be used alone on a bow.

The foregoing disclosure and description of the invention is illustrated and explanatory thereof. To one of skill in this art who has the benefit of this invention's teachings it will be clear that various changes can be made in the apparatuses and methods disclosed within the scope of the appended claims without departing from the spirit of the invention. While there have been described various embodiments of the present invention, the methods and apparatus described are not intended to be understood as limiting the scope of the invention. It is realized that changes therein are possible and it is further intended that each element recited in any of the following claims is to be understood as referring to all equivalent elements for accomplishing substantially the same results in substantially the same or equivalent manner. It is intended to cover the invention broadly in whatever form its principles may be utilized.

What is claimed is:

1. A centralizer for well casing to function in an annular space between the casing and a wellbore, the centralizer having a longitudinal central axis, the wellbore having an upper edge at an upper wellbore opening, the centralizer comprising a pair of spaced-apart and aligned collar means adapted to encircle the casing, a plurality of spring bows extending between and secured to the collar means, each bow having two ends and a bow mid-portion curved outwardly from the longitudinal central axis of the centralizer, the bows disposed so that a bow part of the bow mid-portion is at a bow angle with respect to the upper edge of the wellbore upon insertion of the centralizer into the wellbore, at least one of said bows having at least one contact angle reduction member, the contact angle reduction member comprising a member protruding from the bow part, the contact angle reduction member protruding outwardly with respect to the longitudinal central axis of the centralizer, the contact reduction member contacting the upper edge of the wellbore at a contact angle which is smaller than the bow angle.

2. The centralizer of claim 1 wherein the at least one contact angle reduction member is formed integrally of the bow or bows having such a member.

3. The centralizer of claim 1 wherein the at least one contact angle reduction member is a separate piece secured to the bow or bows having such a member.

4. The centralizer of claim 1 wherein at least one of the said bows has a bow mid-portion with two ends and has two contact angle reduction members, one at each end of the mid-portion of the bow.

5. A spring bow for a well casing centralizer, the centralizer to function in the annular space between a casing and a wellbore, the centralizer having a longitudinal central axis and a pair of spaced-apart and aligned collar means adapted to encircle the casing, the wellbore having an upper edge at an upper wellbore opening, the bow comprising a body member having two ends and a mid-portion disposed between the two ends, the mid-portion curved outwardly from the centralizer's longitudinal central axis, the mid-portion of the bow having a bow part which is at a bow angle with respect to the upper edge of the wellbore upon insertion of the centralizer into the wellbore, the bow having a contact angle reduction member protruding outwardly from the bow part with respect to the longitudinal central axis of the centralizer, the contact angle reduction member contacting the upper edge of the wellbore and a contact angle less than the bow angle.

6. A centralizer for well casing to function in an annular space between the casing and a wellbore, the centralizer having a longitudinal central axis, the centralizer comprising a pair of axially spaced-apart and aligned collar means adapted to encircle the well casing, a plurality of spring bows extending between and secured to said collar means, each bow having two ends and a mid-portion curved outwardly from the longitudinal central axis of the centralizer, the ends secured to the collar means, the bows exerting a restoring force upon emplacement of the centralizer within the wellbore, at least one tubular abutment member for abutting the casing on at least one of said bows, the tubular abutment member comprising an extending member having two ends only one of which is secured to the bow, the tubular abutment member protruding inwardly from the bow toward the centralizer's central axis, the tubular abutment member increasing the bow's restoring force by contacting the casing as the bow is moved into the casing during insertion of the centralizer into the wellbore.

7. The centralizer of claim 6 wherein the tubular abutment member is formed integrally of the bow or bows having such a member.

8. The centralizer of claim 6 wherein the tubular abutment member is a separate piece secured to at least one bow having such a member.

9. The centralizer of claim 6 wherein at least one of said bows having at least one tubular abutment member has two tubular abutment members, one at either end of the outwardly convex curved mid portion of the bow.

10. A spring bow for a well casing centralizer, the centralizer to function in the annular space between a casing and a wellbore, the centralizer having a longitudinal central axis and a pair of spaced-apart and aligned collar means adapted to encircle the casing, the wellbore having an upper edge at an upper wellbore opening, the bow comprising a body member having two ends and a mid-portion disposed therebetween, the mid-portion curved outwardly from the centralizer's longitudinal central axis, the bow exerting a restoring force upon emplacement of the centralizer within the wellbore, and a tubular abutment member for abutting the casing, the tubular abutment member comprising an elongated extending member having two ends only one of which is secured to the bow, and the tubular abutment member protruding inwardly from the bow toward the centralizer's central axis to increase the bow's restoring force by contacting the casing as the bow is moved into the casing during insertion of the centralizer into the wellbore.

11. A centralizer for well casing to function in an annular space between the casing and a wellbore, the centralizer having a longitudinal central axis, the wellbore having an upper edge at an upper wellbore opening, the centralizer comprising a pair of spaced-apart and aligned collar means adapted to encircle the casing, a plurality of spring bows extending between and secured to the collar means, each bow having two ends and a bow mid-portion curved outwardly from the longitudinal central axis of the centralizer, the bows disposed so that a bow part of the bow mid-portion is at a bow angle with respect to the upper edge of the wellbore upon insertion of the centralizer into the wellbore, at least one of said bows having at least one contact angle reduction member, the contact angle reduction member comprising a member protruding from the bow part, the contact angle reduction member protruding outwardly with respect to the longitudinal central axis of the centralizer, the contact reduction member contacting the upper edge of the wellbore at a contact angle which is smaller than the bow angle, and at least one tubular abutment member for abutting the casing on at least one of said bows, the tubular abutment member comprising an extending member having two ends only one of which is secured to the bow, the tubular abutment member protruding inwardly from the bow toward the centralizer's central axis, the tubular abutment member increasing the bow's restoring force by contacting the casing as the bow is moved into the casing during insertion of the centralizer into the wellbore.

12. A spring bow for a well casing centralizer, the centralizer to function in the annular space between a casing and a wellbore, the centralizer having a longitudinal central axis and a pair of spaced-apart and aligned collar means adapted to encircle the casing, the wellbore having an upper edge at an upper wellbore opening, the bow comprising a body member having two ends and a mid-portion disposed between the two ends, the mid-portion curved outwardly from the centralizer's longitudinal central axis, the mid-portion of the bow having a bow part which is at a bow angle with respect to the upper edge of the wellbore upon insertion of the centralizer into the wellbore, the bow having a contact angle reduction member protruding outwardly from the bow part with respect to the longitudinal central axis of the centralizer, the contact angle reduction member contacting the upper edge of the wellbore and a contact angle less than the bow angle, and a tubular abutment member for abutting the casing, the tubular abutment member comprising an elongated extending member having two ends only one of which is secured to the bow, and the tubular abutment member protruding inwardly from the bow toward the centralizer's central axis to increase the bow's restoring force by contacting the casing as the bow is moved into the casing during insertion of the centralizer into the wellbore.

13. A method for employing casing in a wellbore, the method including the steps of disposing a centralizer on the casing, the centralizer comprising a pair of spaced-apart and aligned collar means adapted to encircle the casing, a plurality of spring bows extending between and secured to the collar means, each bow having two ends and a bow mid-portion curved outwardly from the longitudinal central axis of the centralizer, the bows disposed so that a bow part of the bow mid-portion is at a bow angle with respect to the upper edge of the wellbore upon insertion of the centralizer into the wellbore, at least one of said bows having at least one contact angle reduction member, the contact angle reduction member comprising a member protruding from the bow part, the contact angle reduction member protruding outwardly with respect to the longitudinal central axis of the centralizer, the contact angle of reduction member contacting the upper edge of the wellbore at a contact angle less than the bow angle, inserting the casing into the top of the wellbore, and moving the casing so that it is contained within the wellbore.

14. A method for employing casing in a wellbore, the method including the steps of disposing a centralizer on the casing, the centralizer comprising a pair of axially spaced-apart and aligned collar means adapted to encircle the well casing, a plurality of spring bows extending between and secured to said collar means, each bow having two ends and a mid-portion curved outwardly from the central axis of the centralizer, the ends secured to the collar means, the bows exerting a restoring force upon emplacement of the centralizer within the wellbore, at least one tubular abutment member for abutting the casing on at least one of said bows, the tubular abutment member comprising an extending member having two ends only one of which is secured to the bow, the tubular abutment member protruding inwardly from the bow toward the centralizer's central axis, the tubular abutment member increasing the bow's restoring force by contacting the casing as the bow is moved into the casing during insertion of the centralizer into the wellbore, inserting the casing into the top of the wellbore, and moving the casing so that it is contained within the wellbore.

15. A method for employing casing in a wellbore, the method including the steps of disposing a centralizer on the casing, the centralizer comprising a pair of spaced-apart and aligned collar means adapted to encircle the casing, a plurality of spring bows extending between and secured to the collar means, each bow having two ends and a bow mid-portion curved outwardly from the longitudinal central axis of the centralizer, the bows disposed so that a bow part of the bow mid-portion is at a bow angle with respect to the upper edge of the wellbore upon insertion of the centralizer into the wellbore, at least one of said bows having at least one contact angle reduction member, the contact angle reduction member comprising a member protruding from the bow part, the contact angle reduction member protruding outwardly with respect to the longitudinal central axis of the centralizer, the contact reduction member contacting the upper edge of the wellbore at a contact angle which is smaller than the bow angle, and at least one tubular abutment member for abutting the casing on at least one of said bows, the tubular abutment member comprising an extending member having two ends only one of which is secured to the bow, the tubular abutment member protruding inwardly from the bow toward the centralizer's central axis, the tubular abutment member increasing the bow's restoring force by contacting the casing as the bow is moved into the casing during insertion of the centralizer into the wellbore, inserting the casing into the top of the wellbore, and moving the casing so that it is contained within the wellbore.

* * * * *